US007886737B2

(12) United States Patent
McConnell et al.

(10) Patent No.: US 7,886,737 B2
(45) Date of Patent: Feb. 15, 2011

(54) PROTECTIVE EDGE GUARD

(75) Inventors: Thomas E. McConnell, Santa Ynez, CA (US); Francois P. Hacquard, Los Angeles, CA (US)

(73) Assignee: Prince Lionheart, Inc., Santa Maria, CA (US)

( * ) Notice: Subject to any disclaimer, the term of this patent is extended or adjusted under 35 U.S.C. 154(b) by 1284 days.

(21) Appl. No.: 11/247,022

(22) Filed: Oct. 11, 2005

(65) Prior Publication Data

US 2007/0079824 A1 Apr. 12, 2007

(51) Int. Cl.
*F24B 1/192* (2006.01)

(52) U.S. Cl. ..... 126/544; 126/500

(58) Field of Classification Search ..... 126/500, 126/544; 108/27
See application file for complete search history.

(56) References Cited

U.S. PATENT DOCUMENTS 3,869,106 A * 3/1975 Gregov ..... 248/345.1
4,370,373 A * 1/1983 Janicz ..... 428/151
4,787,366 A 11/1988 Bell
4,865,015 A 9/1989 Hasty et al.
4,903,686 A 2/1990 Jennings
4,922,891 A 5/1990 King
5,050,583 A 9/1991 Chapek et al.
5,058,566 A 10/1991 Dabbs et al.
5,199,415 A 4/1993 Johnson, Jr.
5,208,084 A * 5/1993 Rutz ..... 428/40.1
D362,060 S * 9/1995 Jacobs ..... D23/403
5,779,318 A 7/1998 O'Reilly
5,809,901 A * 9/1998 Gutzmer ..... 108/27

* cited by examiner

*Primary Examiner*—Steven B McAllister
*Assistant Examiner*—Sarah Suereth
(74) *Attorney, Agent, or Firm*—Knobbe, Martens, Olson & Bear, LLP

(57) ABSTRACT

An edge guard for use adjacent an edge. The edge guard comprises a cushion member and an edge attachment. The cushion member includes a first face, a second face, and a cushion edge portion disposed between them. Both faces have inner portions extending away from the cushion edge portion towards end portions. The inner portions are positioned adjacent surfaces surrounding the edge. The edge attachment includes an upper surface, an attached end, and a distal end. The attached end is attached to one of the end portions of the cushion member. The edge attachment is stiffer than the cushion member. The upper surface of the edge attachment is separated a distance from the surface it is positioned adjacent that tapers from a larger distance at the attached end to a smaller distance at the distal end.

22 Claims, 3 Drawing Sheets

PROTECTIVE EDGE GUARD

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention relates to a protective edge guard, and in particular to an edge guard having a stiff edge attachment with a tapered upper surface.

2. Description of the Prior Art

Edge guards are commonly used as protective devices for covering the comers of a sharp edge such as of a fireplace hearth, a table, or a counter. These guards are utilized to protect people, especially children, from injuries caused by coming into contact with the sharp edge. A conventional guard consists of a puffy, deformable cushion piece for absorbing impact. This guard is usually fabricated from foam or rubber. Such guards are usually attached to the sharp edge using an easily removable device, such as double-sided tape. However, since the guard is both puffy and deformable, children are easily able to insert their fingers under the edge of the guard and thereby pry the guard off of the sharp edge. The ease by which such guards can be removed by a curious child renders them ineffective as a protective device.

One solution to this problem is to attach the guard in a more permanent manner, such as with nails or screws. However, in many situations the need for such guard is only temporary until the child reaches a certain age. Also, installation and removal of such a guard is more difficult than that of the conventional guard and requires tools. Further, the object the guard is attached to is often decorative and would be ruined upon removal of the guard by the presence of nail or screw holes. As such, this solution is not suited for temporary uses.

Therefore, a need exists for an improved edge guard in comparison to the prior art.

BRIEF SUMMARY OF THE INVENTION

In accordance with an embodiment of the present invention, an edge guard is provided for use adjacent an edge. The edge is disposed between a first surrounding surface and a second surrounding surface. The edge guard includes a cushion member and an edge attachment. The cushion member includes a first face, a second face, and a cushion edge portion disposed between the first face and the second face. The first face is angularly disposed with respect to the second face. The first face has a first face inner portion that extends away from the cushion edge portion towards a first face end portion. The first face inner portion is positionable adjacent the first surrounding surface. The second face has a second face inner portion that extends away from the cushion edge portion towards a second face end portion. The second face inner portion is positionable adjacent the second surrounding surface. The edge attachment includes an upper surface, a distal end, and an attached end. The attached end is attached to the first face end portion. The edge attachment is positionable adjacent the first surrounding surface with the upper surface separated a first distance from the first surrounding surface at the attached end and separated a second distance from the first surrounding surface at the distal end. The second distance is less than the first distance for tapering the upper surface with respect to the first surrounding surface. The edge attachment further has a stiffness greater than the cushion member.

The presence of the stiff tapered edge attachment may mitigate the possibility of children being able to get their fingers underneath the edge guard. The edge attachment is therefore believed to increase the effectiveness of the edge guard by reducing the chances of the edge guard being pried off of the edge.

According to various embodiments, the cushion member may be constructed from a foam material. Further, the cushion member may be constructed from a non-toxic material, a latex-free material, a fire-retardant material, or a material having any combination of these properties. The edge attachment may be constructed from a plastic material. Additionally, the attached end of the edge attachment may be detachably attached to the first face end portion of the cushion member. The edge attachment may include a lower surface that is positionable substantially in contact with the first surrounding surface, the edge attachment thus having a first thickness at the attached end, and a second thickness at the distal end, where the second thickness is less than the first thickness. Further, the upper surface and the lower surface may meet to form an edge at the distal end. The first face end portion may include a lengthwise groove extending parallel to the cushion edge, and the edge attachment may further include a lengthwise protrusion that is positionable within the groove for attaching the edge attachment to the cushion member. The edge guard may further comprise a second edge attachment attached to the second face end portion. The edge guard may also comprise a fastening mechanism for securing the edge guard to the edge. The fastening mechanism may be double-stick tape, an adhesively backed hook-and-loop tape, or other various mechanisms known within the art. The edge guard may also include a plurality of notches, wherein each notch extends from the distal end of the edge attachment through the first face end portion of the cushion member.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF THE INVENTION

Figure 1:
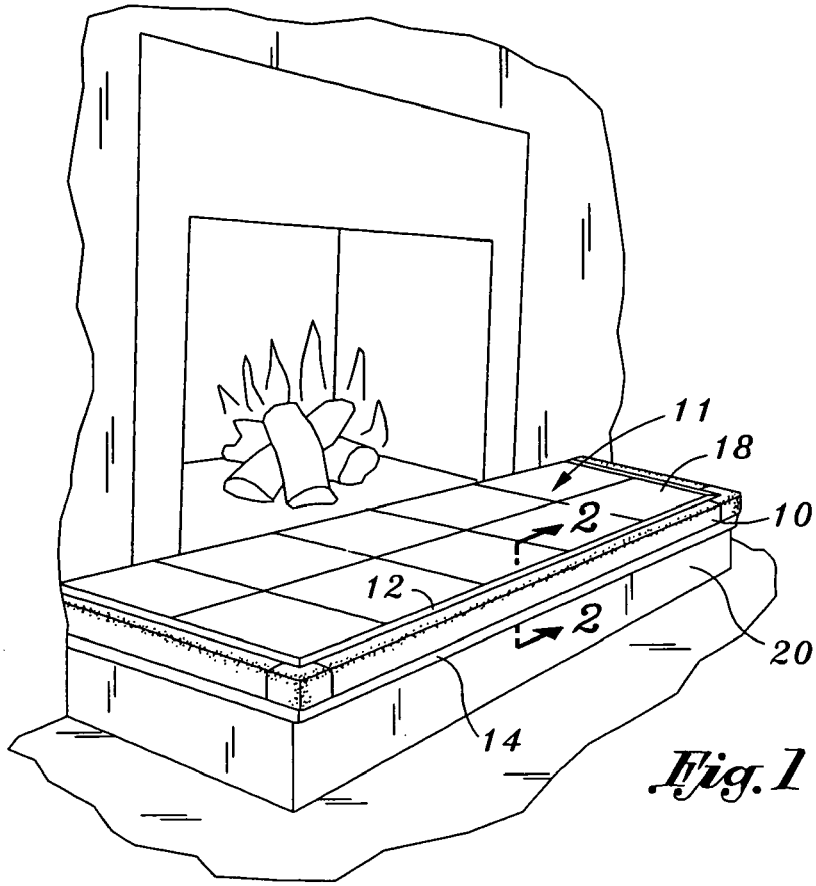
FIG. 1 is a perspective view illustrating an edge guard when mounted on a fireplace hearth.
Figure 2:
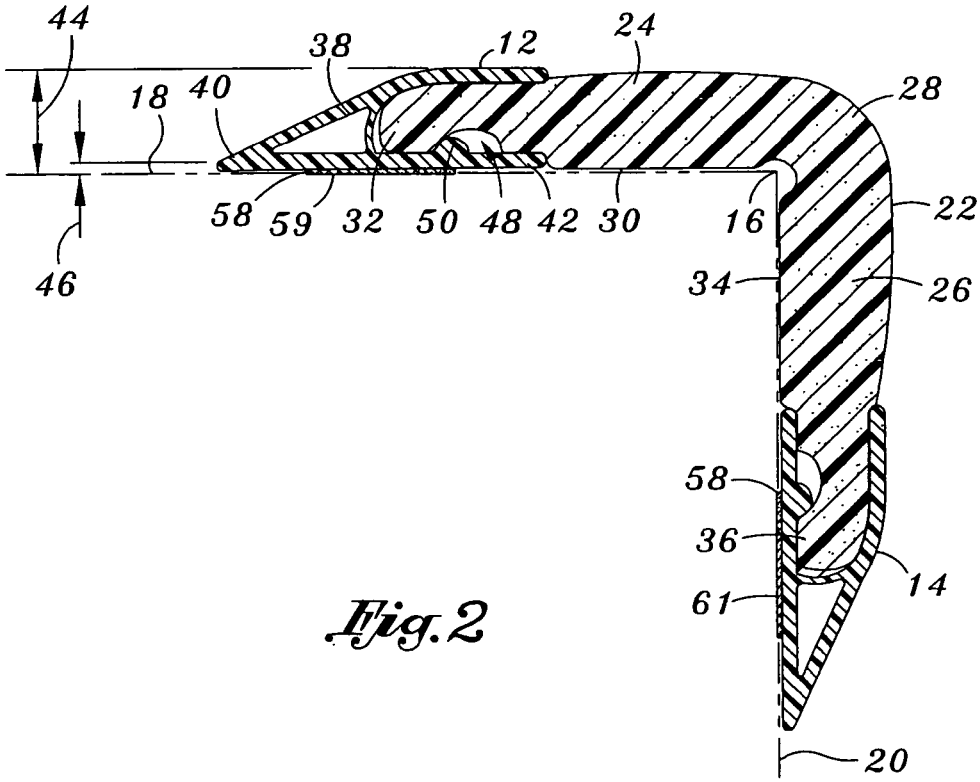
FIG. 2 is an assembled cross sectional view of the edge guard illustrating stiff edge attachments with tapered upper surfaces attached to a cushion member.

Referring now to the drawings wherein the showings are for purposes of illustrating the preferred embodiments of the present invention only and not for purposes of limiting the same, FIG. 1 is a perspective view illustrating an edge guard 10 mounted on a fireplace hearth 11 with edge attachments 12, 14 attached. As illustrated in FIGS. 1 and 2, the edge guard 10 is mounted adjacent an edge 16. The edge 16 is disposed between a first surrounding surface 18 and a second surrounding surface 20.

Referring now to FIG. 2, an embodiment of the edge guard 10 includes a cushion member 22 and an edge attachment 12. The cushion member 22 includes a first face 24, a second face 26, and a cushion edge portion 28. The cushion edge portion 28 is disposed between the first face 24 and the second face 26. The first face 24 is angularly disposed with respect to the second face 26. The first face 24 has a first face inner portion 30 extending away from the cushion edge portion 28 towards a first face end portion 32. The first face inner portion 30 is positionable adjacent the first surrounding surface 18. The second face 26 also has a second face inner portion 34 extending away from the cushion edge portion 28 towards a second face end portion 36. The second face inner portion 34 is positionable adjacent the second surrounding surface 20. The edge attachment 12 includes an upper surface 38, a distal end 40, and an attached end 42. The attached end 42 is attached to the first face end portion 32. The edge attachment 12 is positionable adjacent the first surrounding surface 18 with the upper surface 38 separated a first distance 44 from the first surrounding surface 18 at the attached end 42 and separated a second distance 46 from the first surrounding surface 18 at the distal end 40. As used herein, the term "tapering" means that the second distance 46 is less than the first distance 44. The edge attachment 12 further has a stiffness greater than the cushion member 22.

The cushion member 22 may be formed of a deformable material so as to provide a protective buffer upon impact with the edge 16. It is contemplated that the cushion member 22 may be constructed from a variety of deformable materials, such as a foam material. In an embodiment of the invention, the cushion member 22 is constructed from a non-toxic material so as to be suitable for use in an area where children may be frequently touching the cushion member 22 or inserting it into their mouths. In another embodiment of the invention, the cushion member 22 is constructed from a latex-free material so as to be suitable for use by people allergic to latex, or those concerned with forming latex allergies due to repeated exposure to latex. In a further embodiment of the invention, the cushion member 22 is constructed from a fire-retardant material so as to be suitable for use near a fireplace or other heat producing devices. In a preferred embodiment of the invention, the cushion member 22 is constructed from a non-toxic, latex-free, fire-retardant material.

The deformability of the cushion member 22 is beneficial in reducing injury from impact with an edge 16; however, this same deformability allows children to easily insert their fingers under the deformable end portions 32, 36 and thereby pry the edge guard 10 off of the edge 16. The edge attachment 12 functions to lessen the ability of children to insert their fingers under the edge guard 10 by being stiffer than the cushion member 22. The edge attachment 12 thereby remains substantially non-deformable and helps to prevent the insertion of fingers underneath the edge guard 10.

Further, to effectively absorb an impact and thereby prevent injury, the cushion member 22 must be relatively thick. This thickness, however, provides a potential finger-hold at the end portions 32, 36 whereby children can grab hold of the edge guard 10 and pull it off of the edge 16. The edge attachment 12 makes it more difficult for children to grab hold of the edge guard 10 by tapering to a smaller distance 46 at the distal end 40. The tapering of upper surface 38 may be smooth, wherein the distance from the first surrounding surface 18 decreases at a constant rate from the first distance 44 at the attached end 42 to the second distance 46 at the distal end 40. It is also contemplated that the tapering may consist of a stepped taper, a rounded taper, or an ornamental taper wherein an embossed design is present on the upper surface 38.

It is believed that children would be more likely to insert their fingers underneath the first face end portion 32 due to it being located on top of the first surrounding surface 18 which children may be using as a play surface, or to hold themselves up while standing, or otherwise being more accessible. Therefore, an embodiment of the edge guard may include only one edge attachment 12 attached to the first face end portion 32. However, a further embodiment may include a second edge attachment 14 attached to the second face end portion 36 to also prevent the insertion of fingers underneath the second face end portion 36.

It is contemplated that the edge attachment 12 may be constructed from a variety of materials, so long as they are stiffer than the material used to construct the cushion member 22. This relative stiffness is believed to help in preventing children from inserting their fingers under the relatively deformable cushion member end portions 32, 36. In one embodiment the edge attachment 12 is constructed from a plastic material. Examples of materials that could be used in constructing the edge attachment 12 are wood, metal, or a foam material that is stiffer than the foam material used in constructing the cushion member 22.

Figure 3:
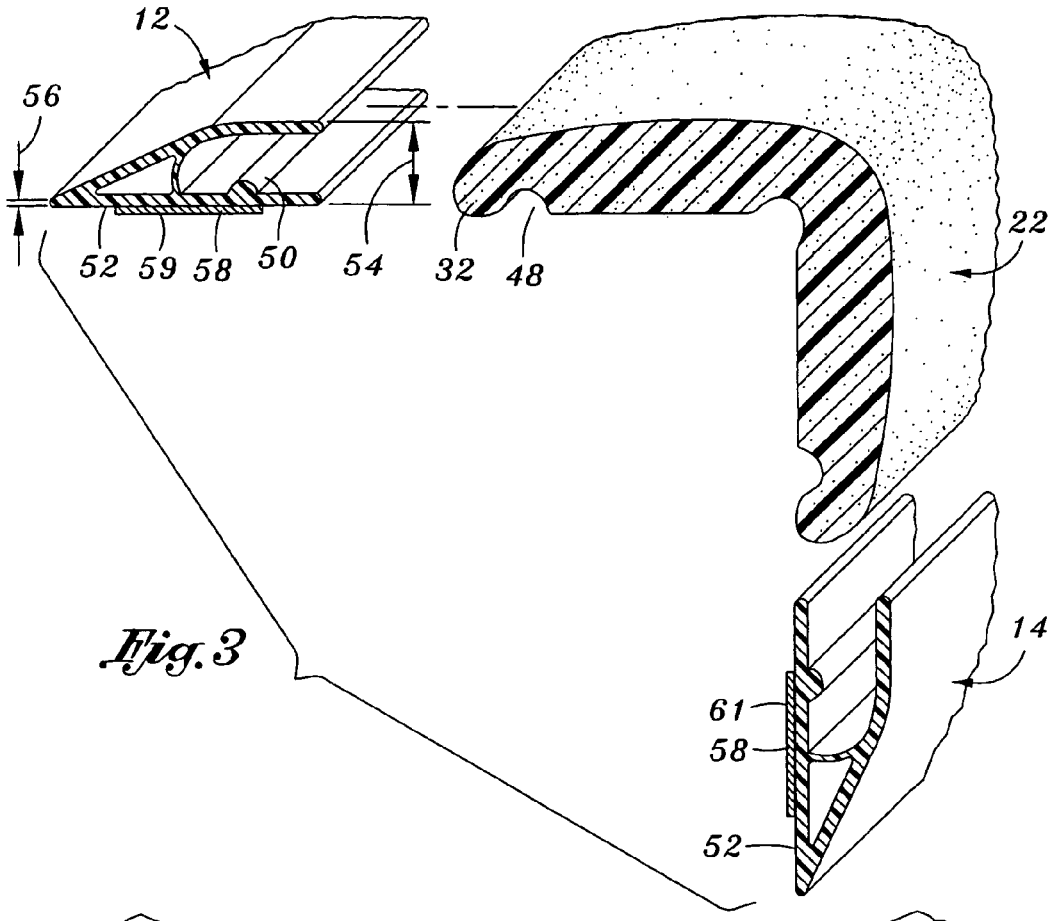
FIG. 3 is an exploded cross sectional view showing the stiff edge attachments detached from the cushion member.
Figure 4:
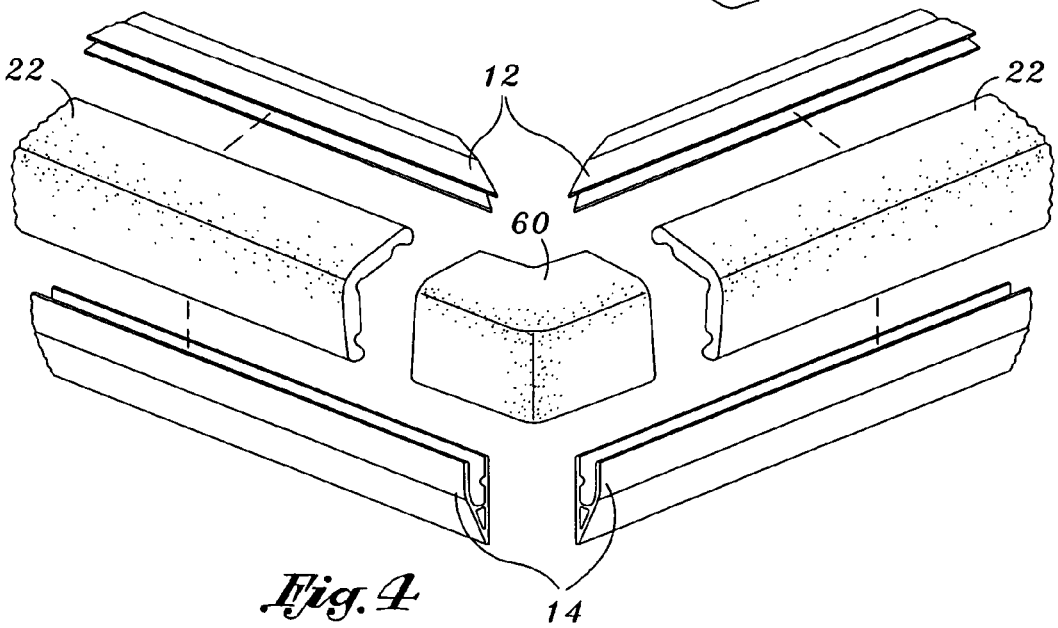
FIG. 4 is an exploded perspective view of the edge guard illustrating the edge guard including a corner piece.

As illustrated in FIGS. 2, 3, and 4, the attached end 42 of the edge attachment 12 may be detachably attached to the first face end portion 32 of the cushion member 22. In a preferred embodiment of the invention, the first face end portion 32 includes a lengthwise groove 48 extending parallel to the cushion edge 28. The edge attachment 12 includes a lengthwise protrusion 50 that is positionable within the groove 48 to create an interlocking mechanism for attaching the edge attachment 12 to the cushion member 22. This mechanism can be temporary, so that the edge attachment 12 is detachably attachable to the cushion member 22. This mechanism can also be made permanent by gluing the protrusion 50 to the groove 48.

In an embodiment of the present invention, the edge attachment 12 includes a lower surface 52 that is positionable substantially in contact with the first surrounding surface 18. The edge attachment 12 thus has a first thickness 54 at the attached end 42 and a second thickness 56 at the distal end 40. The second thickness 56 is less than the first thickness 54. In a further embodiment of the present invention, the upper surface 38 and the lower surface 52 meet to form an edge at the distal end 40.

As can be seen in FIGS. 2 and 3, in another embodiment of the present invention the edge guard 10 further includes a fastening mechanism 58 for securing the edge guard 10 to the edge 16. In a preferred embodiment, the fastening mechanism 58 consists of two strips of double-stick tape 59, 61, wherein the first strip of tape 59 is attached to the lower surface 52 of the first edge attachment 12 and to the first surrounding surface 18 and the second strip of tape 61 is attached to the lower surface 52 of the second edge attachment 14 and to the second surrounding surface 20. It is also contemplated that the first strip of tape 59 could instead be attached to the first face inner portion 30 and the second strip of tape 61 could be attached to the second face inner portion 34. The fastening mechanism 58 may consist of a variety of other mechanisms, including, but not limited to, a liquid glue, a spray-on adhesive, an adhesively backed hook-and-loop tape, or a plurality of suction cups.

Referring now to FIG. 4, the edge guard 10 may further include a generally L-shaped corner piece 60. The corner piece 60 is formed by inserting a bend of a certain angle, generally 90 degrees, into a cushion member 22. In one embodiment, the corner piece 60 is positioned adjacent a cushion member 22. In an alternative embodiment, the comer piece 60 is integrally attached to a cushion member 22. The edge attachment 12 may extend past the cushion member 22 so as to also attach to the comer piece 60. It is contemplated that a further embodiment of the present invention includes positioning multiple cushion members 22 adjacent to each other, with or without a comer piece 60 disposed between, so as to cover the entire edge 16.

Figure 5:
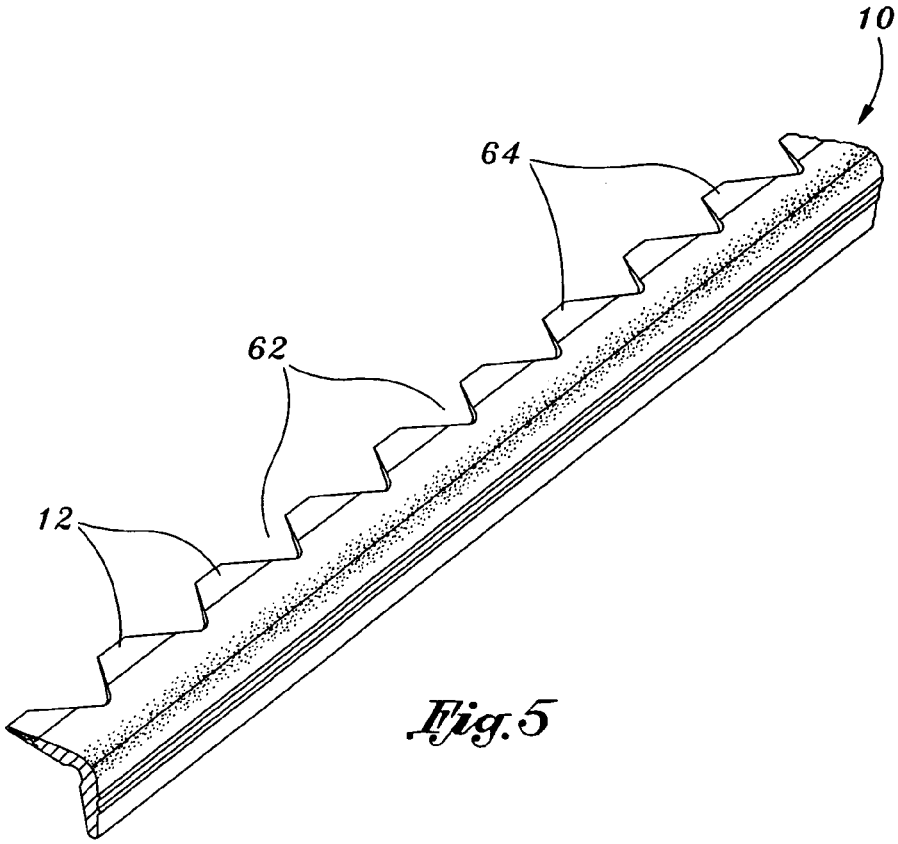
FIG. 5 is a perspective view illustrating another embodiment of the edge guard comprising a plurality of notches.
Figure 6:
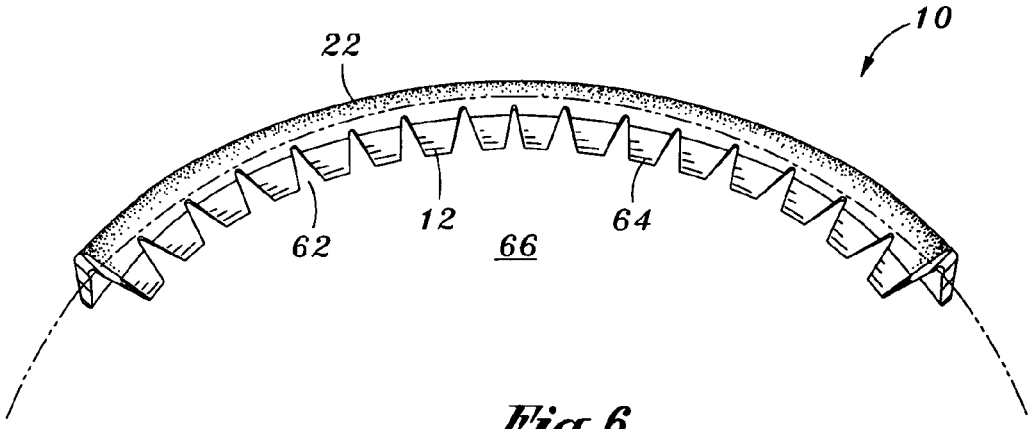
FIG. 6 is a perspective view showing an embodiment of the edge guard with a plurality of notches mounted to a rounded surface.

FIG. 5 illustrates a further embodiment of the invention in which the edge guard 10 includes a plurality of notches 62. Each notch 62 extends from the distal end 40 of the edge attachment 12 through the first face end portion 32 of the cushion member 22. The presence of these notches 62 in the edge guard 10 creates an alternating series of notches 62 and protrusions 64. The notches 62 allow the edge guard 10 to be manipulated in such a way that the protrusions 64 may be brought together and/or moved away from each other in order for the edge guard 10 to conform to the edge of a non-linear surface. FIG. 6 illustrates an edge guard 10 with a plurality of notches 62 mounted to such a non-linear surface, in this case a rounded table 66. Although shown mounted to a convex surface, it is to be understood that the presence of the notches 62 allows for the edge guard 10 to be mounted to either a convex or a concave surface, or even a convoluted surface having a combination of the two.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An edge guard for use adjacent an edge, the edge being disposed between a first surrounding surface and a second surrounding surface, the edge guard comprising:

a cushion member including a first face, a second face, and a cushion edge portion disposed between the first face and the second face, the first face being angularly disposed with respect to the second face, the first face having a first face inner portion extending away from the cushion edge portion towards a first face end portion, the first face inner portion being positionable adjacent and generally parallel to the first surrounding surface, the second face having a second face inner portion extending away from the cushion edge portion towards a second face end portion, the second face inner portion being positionable adjacent and generally parallel to the second surrounding surface, wherein the first face and the second face generally meet near the edge; and an edge attachment including a lower surface and an upper surface, a distal end, and an attached end, the attached end being attached to the first face end portion, the edge attachment being positionable adjacent the first surrounding surface with the upper surface separated a first distance from the first surrounding surface at the attached end and separated a second distance from the first surrounding surface at the distal end, the second distance being less than the first distance for tapering the upper surface with respect to the first surrounding surface, the edge attachment further having a stiffness greater than the cushion member;

wherein the lower surface of the edge attachment is generally parallel to the first surrounding surface substantially throughout an entire length of the edge attachment;

wherein the cushion member is configured to directly contact the first surrounding surface along the first face inner portion, and wherein the cushion member is configured to directly contact the second surrounding surface along the second face inner portion when the edge guard is properly positioned adjacent an edge;

wherein the edge guard is configured to at least temporarily secure to at least one of the first surrounding surface and the second surrounding surface using an adhesive; and wherein, when properly secured to at least one of the first surrounding surface and the second surrounding surface, the edge guard is configured to extend either completely or partially along a length of an edge.

2. The edge guard of claim 1 wherein the cushion member is constructed from a foam material.

3. The edge guard of claim 1 wherein the cushion member is constructed from a non-toxic material.

4. The edge guard of claim 1 wherein the cushion member is constructed from a latex-free material.

5. The edge guard of claim 1 wherein the cushion member is constructed from a fire-retardant material.

6. The edge guard of claim 1 wherein the edge attachment is constructed from a plastic material.

7. The edge guard of claim 1 wherein the attached end is detachably attached to the first face end portion.

8. The edge guard of claim 1 wherein the lower surface of the edge attachment is positionable substantially in contact with the first surrounding surface, the edge attachment having a first thickness at the attached end, the edge attachment further having a second thickness at the distal end, the second thickness being less than the first thickness.

9. The edge guard of claim 8 wherein the upper surface and the lower surface meet to form an edge at the distal end.

10. The edge guard of claim 1 wherein the first face end portion includes a lengthwise groove extending parallel to the cushion edge, and the edge attachment includes a lengthwise protrusion positionable within the groove for attaching the edge attachment to the cushion member.

11. The edge guard of claim 1 further comprises a second edge attachment attached to the second face end portion.

12. The edge guard of claim 1 further comprises a fastening mechanism for securing the edge guard to the edge.

13. The edge guard of claim 12 wherein the fastening mechanism is selected from the group consisting of double-stick tape and an adhesively backed hook-and-loop tape.

14. The edge guard of claim 1 further comprises a plurality of notches, wherein each notch extends from the distal end of the edge attachment through the first face end portion of the cushion member.

15. An edge guard for use along an edge of an object, said edge generally formed by a first surface and a second surface angularly disposed relative to the first surface, said edge guard comprising:

a cushion member comprising a first portion and a second portion angularly disposed relative to the first portion;

the cushion member further comprising a cushion edge portion generally located at an interface between the first and second portions;

wherein the first portion extends along the first surface to a first end, and wherein the second portion extends along the second surface to a second end, such that each of said first and second ends is located generally away from the cushion edge portion; and a first edge attachment member secured to the first end of the cushion member and configured to extend along the first surface;

wherein the first edge attachment member comprises an attached end and a distal end, said attached end secured to the first end of the first portion of the cushion member, and said distal end extending along the first surface in a direction generally away from the cushion edge portion;

wherein the first edge attachment member comprises a lower surface configured to contact the first surface and an upper surface generally opposite the lower surface, said lower and upper surfaces of the first edge attachment member being separated a first distance at the attached end and separated a second distance at the distal end, said second distance being less than the first distance so that the first edge attachment member has a generally tapered design;

wherein a stiffness of the first edge attachment member is greater than a stiffness of the cushion member;

wherein an surface of the cushion member is configured to directly contact the object when the edge guard is properly positioned on the object; and wherein the edge guard is configured to at least temporarily secure to at least one adjacent surface of the object using an adhesive.

16. The edge guard of claim 15, wherein the cushion member comprises foam.

17. The edge guard of claim 15, further comprising a second edge attachment member secured to the second end of the cushion member and configured to extend along the second surface.

18. The edge guard of claim 17, wherein the second edge attachment member comprises a generally tapered design.

19. The edge guard of claim 15, wherein the object is a fireplace hearth, a table or a counter.

20. The edge guard of claim 1 wherein the edge is located on a fireplace hearth, a table or a counter.

21. The edge guard of claim 15, wherein the adhesive is directly applied to at least one of the cushion member and the first edge attachment member.

22. The edge guard of claim 15, wherein the adhesive comprises adhesive tape.

* * * * *